US012546065B2

(12) United States Patent
Zhu

(10) Patent No.: US 12,546,065 B2
(45) Date of Patent: Feb. 10, 2026

(54) SURFACE SEAMLESS STEEL RAIL

(71) Applicant: SUZHOU TRUERUN ENVIRONMENT TECHNOLOGY LTD., Suzhou (CN)

(72) Inventor: Shoulian Zhu, Jacksonville, FL (US)

(73) Assignee: SUZHOU TRUERUN ENVVIRONMENT TECHNOLOGY LTD., Jiangsu (CN)

( * ) Notice: Subject to any disclaimer, the term of this patent is extended or adjusted under 35 U.S.C. 154(b) by 801 days.

(21) Appl. No.: 17/779,003

(22) PCT Filed: Aug. 26, 2020

(86) PCT No.: PCT/CN2020/111239
§ 371 (c)(1),
(2) Date: May 23, 2022

(87) PCT Pub. No.: WO2021/114725
PCT Pub. Date: Jun. 17, 2021

(65) Prior Publication Data

US 2022/0412015 A1 Dec. 29, 2022

(30) Foreign Application Priority Data

Dec. 12, 2019 (CN) ..... 201911278113.7

(51) Int. Cl.
*E01B 11/24* (2006.01)
*E01B 5/08* (2006.01)
*E01B 11/26* (2006.01)

(52) U.S. Cl.
CPC ..... *E01B 11/24* (2013.01); *E01B 5/08* (2013.01); *E01B 11/26* (2013.01)

(58) Field of Classification Search
CPC ..... E01B 11/24; E01B 5/08; E01B 11/26
See application file for complete search history.

(56) References Cited

U.S. PATENT DOCUMENTS 1,346,384 A * 7/1920 Rightnour ..... E01B 11/26 238/235
1,856,648 A * 5/1932 Lorentowicz ..... E01B 11/26 238/233

(Continued)

FOREIGN PATENT DOCUMENTS

CN 206308562 U 7/2017
CN 107841909 A 3/2018

(Continued)

OTHER PUBLICATIONS

International Search Report from corresponding International Application No. PCT/CN2020/111239, mailed on Nov. 26, 2020, 4 pages.

*Primary Examiner* — Jason C Smith
(74) *Attorney, Agent, or Firm* — Tucker Ellis LLP

(57) ABSTRACT

A surface-seamless steel rail is provided in the present invention. Said surface-seamless steel rail includes a right connecting part located on one side of said steel rail, a left connecting part located on the other side of said steel rail, and a seamless spring piece located on the top side of said steel rail. Both said left connecting part and said right connecting part include a plug portion in embedded engagement with each other. Said seamless spring piece includes a fixed portion at one end and a free portion at the other end, said fixed portion is fixedly connected on top side of said plug portion of one of said left connecting part and said right connecting part. The other of said left connecting part and said right connecting part is provided with an arc-shaped channel at its interior body, said free portion of said seamless spring piece is suitably inserted into said arc-shaped channel.

13 Claims, 4 Drawing Sheets

(56) References Cited

U.S. PATENT DOCUMENTS

| | | | | |
|---|---|---|---|---|
| 6,354,057 | B1 * | 3/2002 | Ploplis | B29C 66/1162 52/287.1 |
| 2006/0107613 | A1 * | 5/2006 | Chung | E04F 11/1846 52/832 |
| 2022/0412015 | A1 * | 12/2022 | Zhu | E01B 11/24 |

FOREIGN PATENT DOCUMENTS

| | | | | |
|---|---|---|---|---|
| CN | 208072098 | U * | 11/2018 | |
| CN | 208965320 | U * | 6/2019 | |
| CN | 110939021 | A * | 3/2020 | E01B 11/24 |
| CN | 210561498 | U * | 5/2020 | |
| GB | 191307094 | A * | 7/1913 | |

* cited by examiner

SURFACE SEAMLESS STEEL RAIL

TECHNICAL FIELD

The present invention relates to the technical field of railway tracks. Specifically, the present invention relates to a steel rail with a seamless surface.

BACKGROUND ART

With the development and popularization of high-speed rail, high-speed trains and other trains, the travel speed of trains has increasingly raised, and now it has entered the stage of ballastless tracks, so high-speed trains have increasingly higher requirements for the track rails. In the past, when the trains traveled on the traditional tracks, there were always bumps and rumbling noises. This was due to the gaps at the joints of the railway rails, which caused the entire railway to be bumpy. Therefore, trains traveling on the traditional tracks are accompanied by noises and cannot be driven at high speed.

To solve the aforementioned problems, currently seamless welded rails are used for most railways, which allows trains to travel at high speed without making noises. However, the laying of the rails needs to consider the hidden risks caused by the thermal expansion and contraction. Temperature variations between the day and the night and the seasonal temperature differences will cause problems such as rail buckling or rail breakage. Therefore, when laying the rail, it is necessary to consider the hidden risk brought by thermal expansion and contraction. To mitigate this hidden risk, when laying seamless welded rails, the temperature of the rails must be controlled at a predetermined value. At the same time, multiple approaches should be adopted to solve the problem, for example, using high-strength rails, increasing the strength of fasteners, bending the rails at larger curves, inspecting the rails at nighttime or before the arrival of the first train, adjusting the rails when change of season, and replacing the rails on bridges or in regions when high-temperature change is expected. At the same time, the laying of seamless welded rails requires pre-welding of multi rails in a factory, and then transporting the welded long rails to the construction site, and the welding of these welded long rails has to be performed again at the construction site. However, the welded long rails from the factory to be transported can often reach up to 100 meters. These laying and inspection methods of the welded long rails are time-consuming and labor-intensive, which significantly increase the construction cost. At the same time, these methods can only control the possibility of hidden risks and eliminate them in the shortest time after they appear, but cannot fundamentally solve the problem. For example, when a track fault occurs after the first run, subsequent trains for the rest of the day will run on the faulty rail and a significant potential disaster could occur. In addition, troubleshooting hidden risk often takes a long time, which may affect the pre-set train schedule of the day on this railway line and other related lines, causing significant inconveniences to many passengers and economic losses.

Some non-welded steel rail designs have been invented to solve the aforementioned problem due to thermal expansion and contraction, such as disclosed in Chinese utility model patent 201621273608.2 ("Plug-in type rail") and Chinese patent application 201711264975.5 ("Method for connecting steel rails in finger-joint and seam-reservation modes"). The Chinese utility model patent 201621273608.2 discloses a rail with a convex connecting body and a concave connecting body at both ends of the joint, and fixed splints are provided on both sides of the rail. The Chinese patent application 201711264975.5 discloses a rail with a toothed end to solve the thermal expansion and contraction problem. Although this type of rail solves the hidden risks caused by thermal expansion and contraction, it will leave many gaps on the upper surface of the rail. Therefore, it can only be used for low-speed trains. When high-speed trains pass through these types of connections, the wheels of the high-speed trains will resonate and collide at high speed with the track, resulting a danger of loosening the rail-track base, destroying the rails, and breaking the wheel axle. Therefore, it lacks a suitable rail that can solve the problem of thermal expansion and contraction while ensuring a smooth run of the high-speed train.

SUMMARY

The purpose of the present invention is to provide a surface-seamless steel rail that can solve the above-mentioned problem of thermal expansion and contraction and meanwhile ensuring the smooth running of the train.

The present invention provides a surface-seamless steel rail comprising: a right connecting part located on one side of said steel rail, a left connecting part located on the other side of said steel rail, and a seamless spring piece located on the top side of said steel rail, wherein both said left connecting part and said right connecting part include a plug portion in embedded engagement with each other, said seamless spring piece includes a fixed portion at one end and a free portion at the other end, said fixed portion is fixedly connected on the top side of said plug portion of one of said left connecting part and said right connecting part, the other of said left connecting part and said right connecting part is provided with an arc-shaped channel at its interior, said free portion of said seamless spring piece is suitably inserted into said arc-shaped channel.

In an embodiment of the present invention, the fixed connection of said seamless spring piece can be realized by welding.

In an embodiment of the present invention, said seamless spring piece is comprised of a plurality of spring sheet layers that are flatly stacked at said fixed portion and welded together, and the end of said free portion of said seamless spring piece has a shape that fits into said arc-shaped channel.

In an embodiment of the present invention, the end of said free portion of said seamless spring piece is in an angle of less than 90 degrees.

In an embodiment of the present invention, said left connecting part and said right connecting part have the same overall height, and wherein said plug portions of said left connecting part and said right connecting part have the same height and the same length.

In an embodiment of the present invention, the height of said plug portion is less than the height of said left connecting part and said right connecting part, wherein the difference in height equals to the thickness of said seamless spring piece.

In an embodiment of the present invention, the outer edge of said arc-shaped channel coincides with the top of said left connecting part or said right connecting part that is immediately adjacent to said plug portion.

In an embodiment of the present invention, the fit tolerance between said free portion of said seamless spring piece and said arc-shaped channel is in the range of 0.03 mm to 0.1 mm that corresponds to a thickness value by which the thickness of said seamless spring piece is greater than the breadth of said arc-shaped channel.

In an embodiment of the present invention, the maximum length of said fixed portion of said seamless spring piece may be the same as said plug portions of said left connecting part and said right connecting part, or only at a length that is necessary to meet the requirements of welding strength.

In addition, when the length of said fixed portion of said seamless spring piece is smaller than the length of said plug portion, the less portion at the top portion of the connecting parts with equal height extends laterally towards the top of said plug portion.

In an embodiment of the present invention, the length of said free portion of said seamless spring piece is determined by the product of the segment rail length, the rail thermal expansion coefficient, the regional maximum temperature difference, and a correction factor. Said correction factor is selected between 1.05 and 1.2, preferably 1.1.

The present invention ensures that the entire rail is a smooth and seamless rail no matter in cold or hot weather, so as to ensure that any risks, bumps and noises due to thermal expansion and contraction will not occur when the train runs on, and at the same time, it dramatically reduces the costs of construction and rail maintenance for high-speed rails.

According to the present invention, the existing high-speed rail system can be rapidly and cost-effectively modified, and the traditional low-speed rail can also be easily reconstructed. Therefore, the regular rail tracks can run more smoothly and noiselessly, the maintenance and management costs can be reduced, and the running speed can be significantly increased, even to the level of high-speed trains.

BRIEF DESCRIPTION OF THE DRAWINGS

Now, a detailed description of the present invention will be provided with reference to the accompanying drawings.

EMBODIMENTS OF THE INVENTION

To better understand the present invention, the content of the present invention is further illustrated below in conjunction with the embodiments, but the present invention is not limited to the following specific embodiments.

Figure 4:
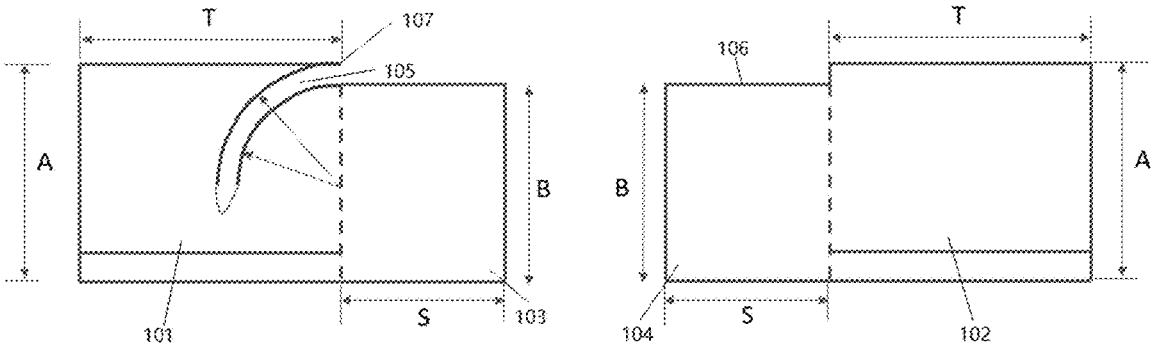
FIG. 4 is a schematic diagram of a front view of a left connecting part and a right connecting part of a steel rail, according to an embodiment of the present invention.

FIG. 4 illustrates a front view of an embodiment of a left connecting part 101 and a right connecting part 102 not yet connected together.

In this embodiment, the left connecting part 101 is provided with an arc-shaped channel 105 and has a left plug portion 103, and the overall shape of the left connecting part 101 is similar to the shape of the steps of a staircase. The plug portion 103 is located at the right end of the left connecting part 101, and is located on the right side of the arc-shaped channel 105, and its height is slightly lower than the height of the left half of the left connecting part 101. Therefore, the left connecting part 101 as a whole presents a shape with a high step on the left and a low step on the right. The arc-shaped channel 105 is in the shape of a circular arc, which is located in the middle of the left connecting part 101, and the top of the outer edge of the arc-shaped channel 105 is consistent with the top plane of the left connecting part.

The right connecting part 102 has a plug portion 104 on the side opposite to the plug portion 103. The right connecting part 102 also has a stepped shape similar to a staircase but is opposite to the stepped shape of the left connecting part 101, showing a shape with a higher right portion but a lower left portion. The top 106 of the plug portion 104 is used for welding with the seamless spring piece 201, while the side of the right connecting part 102 with height difference from the plug portion 104 also needs to be welded to the seamless spring piece 201 during welding in order to make the steel rail surface seamless.

The overall heights of the left connecting part 101 and the right connecting part 102 are the same, both are height A. The length and height of the plug portion 103 and the plug portion 104 are also the same to match to be cross-embedded with each other, their lengths are both S, and their heights are both B. Wherein, the length S is the product of the segment rail length, the thermal expansion coefficient of the steel rail, the regional maximum temperature difference and a correction factor. The correction factor is selected between 0.9 and 1.2, preferably 1.

The height B of the plug portion 103 and the plug portion 104 is smaller than the overall height A of the left connecting part 101 and the right connecting part 102, and the height difference is the breadth of the arc-shaped channel 105, which is also the thickness of the seamless spring piece 201. The left edge and the right edge of the arc-shaped channel 105 are two concentric arc edges. In this embodiment, the left edge of the arc-shaped channel 105 is slightly longer than the right edge, and the length of the outer edge is slightly longer than the length S of the plug portion.

Figure 5:
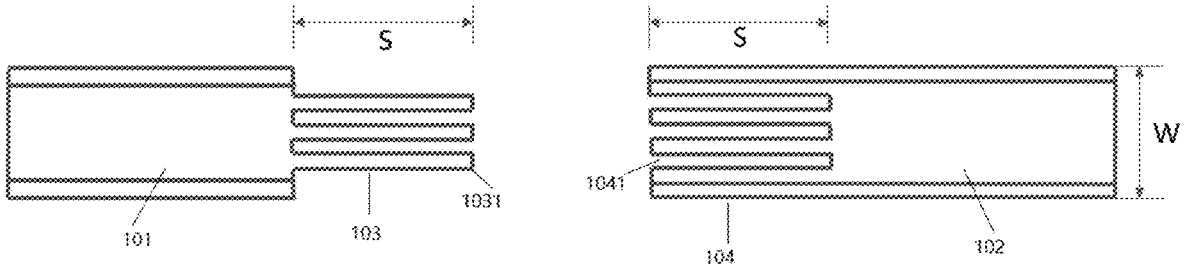
FIG. 5 is a schematic diagram of a top view of a left connecting part and a right connecting part of a steel rail, according to an embodiment of the present invention.

FIG. 5 is a top view showing the left connecting part 101 and the right connecting part 102 of this embodiment. As shown in FIG. 5, the overall widths of the left connecting part 101 and the right connecting part 102 are the same, and their widths are both W. In this embodiment, the plug portion 103 and the plug portion 104 are embedded structures that fit into each other, wherein the plug portion 103 has three protrusions 1031 in the shape of teeth, and the plug portion 104 has four notches 1041 that correspond to the length S of protrusions 1031. The corresponding notch 1041 is adapted to accommodate the protrusion 1031. The fit tolerance between the plug portion 103 and the plug portion 104 is in the range of ±0.1 mm, preferably ±0.05 mm.

Figure 6:
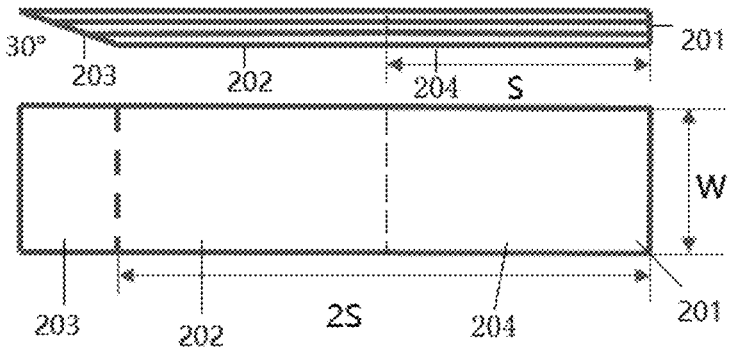
FIG. 6 are schematic diagrams of a front view and a top view of a seamless spring piece of a steel rail, according to an embodiment of the present invention.

FIG. 6 shows the seamless spring piece 201 of this embodiment. The seamless spring piece 201 is generally in the shape of an elongated flat plate and includes a free portion 202 at one end. The free portion 202 has a head portion 203. The seamless spring piece 201 also includes a fixed portion 204 at the other end. In FIG. 6, the fixed portion 204 is located at the right end of the seamless spring piece 201 and is used for welding at the corresponding position on the right connecting part 102.

In this embodiment, the seamless spring piece 201 is formed by flatly stacking three layers of spring sheets and then welded on the fixed portion 204, while the free portion 202 does not require welding. In FIG. 6, the free portion 202 is located at the left end of the seamless spring piece 201, which is used for inserting into the arc-shaped channel 105 to form a seamless smooth surface on the upper surface of the steel rail. Since the free portion 202 is not welded, three layers of spring piece which constitutes the seamless spring piece 201 can freely deform and slide. Therefore, when it is inserted into the arc-shaped channel 105, it can be ensured that it can fully match the shape of the arc-shaped channel 105, and the internal stress caused by the bending of the free portion of the spring piece can be reduced. In addition, matching insertion is guaranteed because mismatching due to deformation caused by thermal expansion and contraction, for example, is avoided. Due to its elasticity, the free portion 202 will always be against the left side of the arc-shaped channel 105. Even in the case of the seamless spring piece 201 being thinned due to extreme cold, it can also ensure that the seamless spring piece 201 always pushes against the left side of the arc-shaped channel 105, thereby ensuring that the top plane of the left connecting part 101 is free of gaps.

In this embodiment, the fixed portion 204 of this seamless spring piece 201 has the same length S to match the plug portion 104, and the length of the free portion 202 of the seamless spring piece 201 including its head 203 is slightly longer than the length S. In order to facilitate the embedding, the head 203 has an inclination angle of about 30 degrees. The width of the seamless spring piece 201 is the same as the width W of the left connecting part 101 and the right connecting part 102 and its cross-section is identical to the cross-section of the top of the steel rail so that a complete smooth top plane can be formed after the coupling of the left connecting part 101 and the right connecting part 102.

Figure 1:
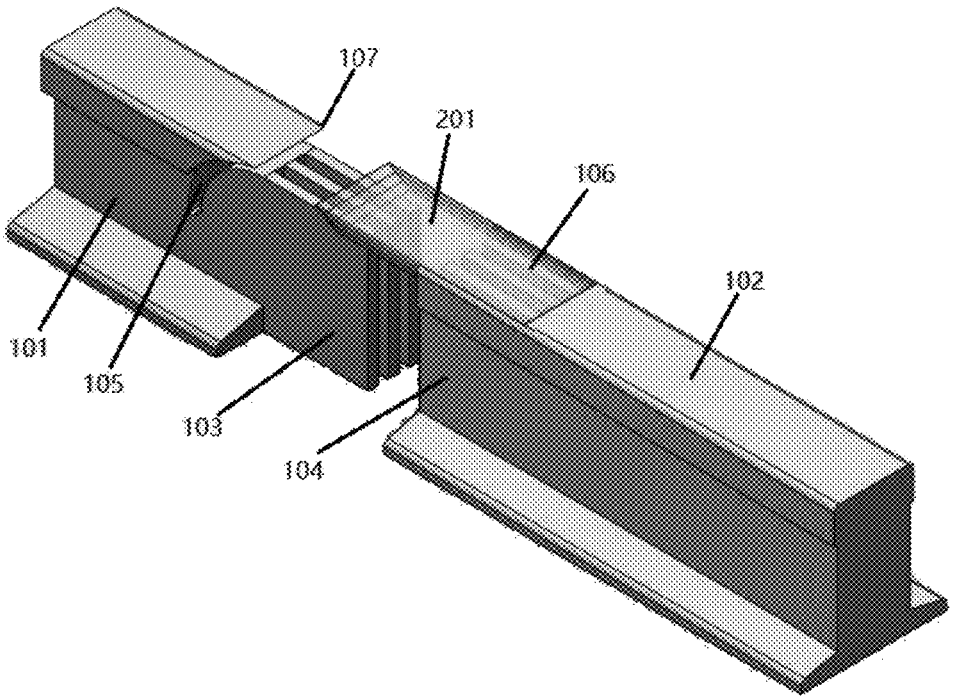
FIG. 1 illustrates a perspective view of a left connecting part and a right connecting part not yet connected when a seamless spring piece has been welded to the right connecting part, according to the present invention.
Figure 2:
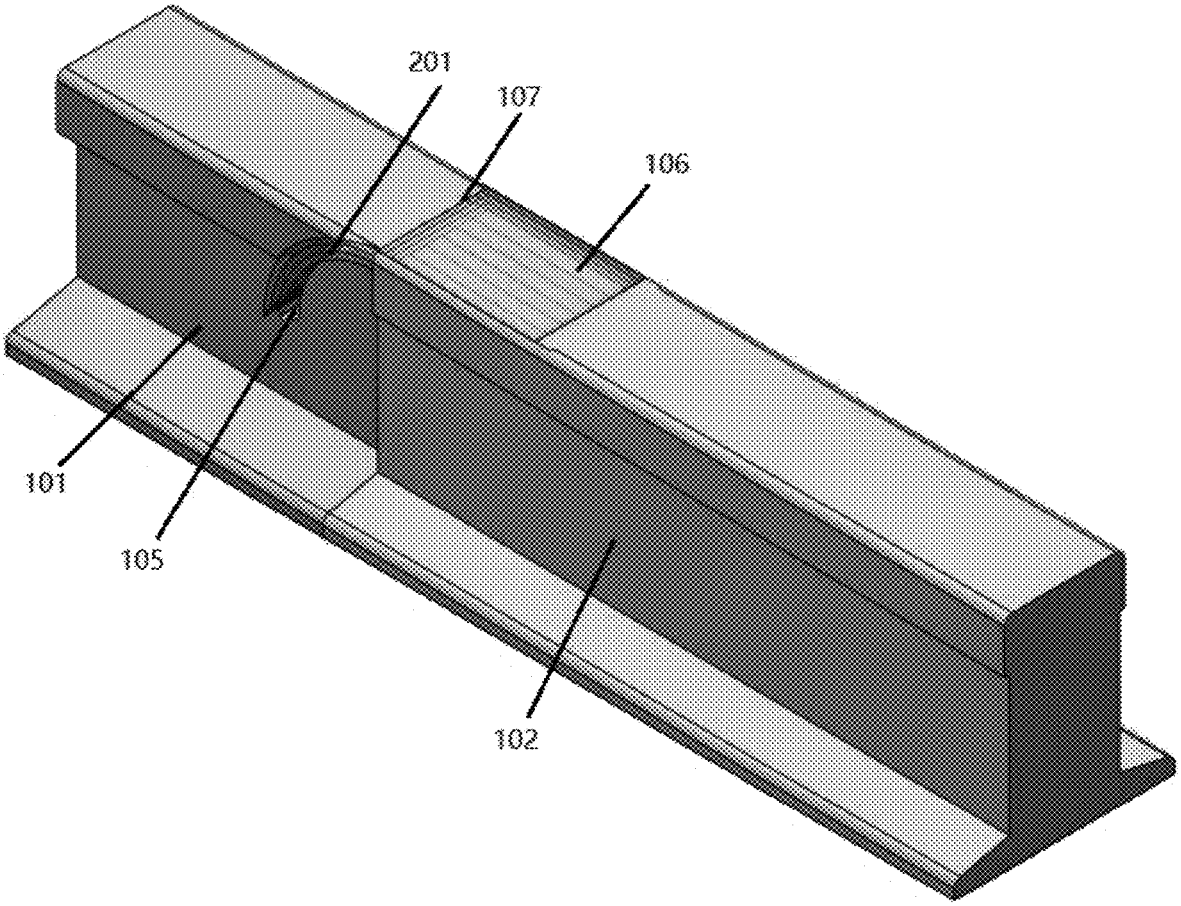
FIG. 2 illustrates a perspective view of a left connecting part and a right connecting part having been connected together when a seamless spring piece has been welded to the right connecting part, according to the present invention.
Figure 3:
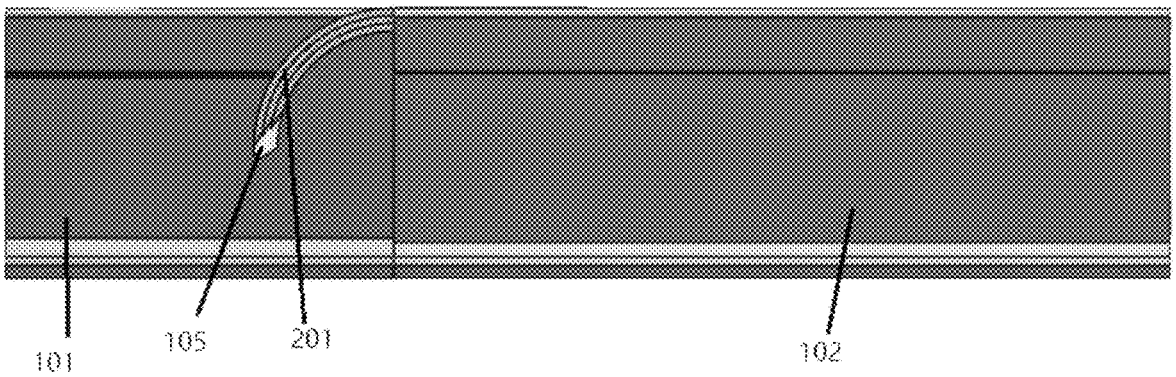
FIG. 3 illustrates a side view of a left connecting part and a right connecting part having been connected together when a seamless spring piece has been welded to the right connecting part, according to the present invention.

FIG. 1 illustrates a perspective view of the left connecting part 101 and the right connecting part 102 not yet connected when the seamless spring sheet 201 of this specific embodiment has been welded to the right connecting part 102. FIG. 2 illustrates a perspective view of the left connecting part 101 and the right connecting part 102 being connected when the seamless spring piece 201 of this specific embodiment has been welded to the right connecting part 102. FIG. 3 illustrates a side view of the left connecting part 101 and the right connecting part 102 being connected when the seamless spring piece 201 of this specific embodiment has been welded to the right connecting part 102.

It can be seen from the figures that the sum of the thickness of the seamless spring piece 201 and the height B of the plug portion 103 and the plug portion 104 exactly matches the height A of the left connecting part 101 and the right connecting part 102, so that when this seamless spring piece 201 is welded to the top 106 of the plug portion 104 of the right connecting part 102, the top of the right connecting part 102 forms a smooth, seamless surface of the steel rail.

When the left connecting part 101 connects with the right connecting part 102, the plug portion 103 and the plug portion 104 are cross-embedded with each other, and at the same time, the free portion 202 of the seamless spring piece 201 slides into the arc-shaped channel 105 of the left connecting part 101, and the arc-shaped channel 105 can cooperate to accommodate the free portion 202 of the seamless spring piece 201, and the left edge of arc-shaped channel 105 mates with the top surface 107 (immediately adjoin to the plug portion 103) of the left connecting part 101, so that when the seamless spring piece 201 is inserted into the arc-shaped channel 105, the seamless spring piece 201 can form a seamless fit with the top surface, therefore, after the left connecting part 101 is connected with the right connecting part 102, the top of the left connecting part 101 is a smooth, seamless surface. The fit tolerance between the seamless spring piece 201 and the arc-shaped channel 105 ranges between +0.05 mm and 0.1 mm.

Whether in wintertime, during low temperature, summertime, or during high temperature, the free portion 202 of the seamless spring piece 201 can be extended or shortened, due to thermal expansion and contraction, within the arc-shaped channel 105, and will not come out of the arc-shaped channel 105 or be too long to push again the arc-shaped channel 105. Due to the characteristics of the spring piece, the seamless spring piece 201 will always keep a seamless fit with the top of the left connecting part 101, so as to ensure that the top of the left connecting part 101 and the top of the right connecting part 102 are always smooth and seamless. At the same time, because the plug portion 103 and the plug portion 104 have a dynamic fit accuracy of approximately 0.1 mm, it can ensure that the left connecting part 101 and the right connecting part 102 will not be affected by thermal expansion and contraction.

The present invention ensures that the entire rail is a smooth and seamless rail whether in cold or in hot weather, so as to ensure that any risks, bumps and noises due to thermal expansion and contraction will not occur when the train passes by, and at the same time, it dramatically reduces the costs of maintaining the rail. According to the present invention, the existing rail system can be rapidly and cost-effectively reconstructed, so that the locomotive can run more smoothly and noiselessly, the maintenance and management costs can be reduced, and the running speed can be significantly increased, even to the level of high-speed trains.

What is claimed is:

1. A surface-seamless steel rail, comprising:

a right connecting part located on one side of said steel rail;

a left connecting part located on the other side of said steel rail; and a seamless spring piece located on the top side of said steel rail, wherein both said left connecting part and said right connecting part include a plug portion in embedded engagement with each other, said seamless spring piece includes a fixed portion at one end and a free portion at the other end, said fixed portion is fixedly connected on the top side of said plug portion of one of said left connecting part and said right connecting part, the other of said left connecting part and said right connecting part is provided with an arc-shaped channel at its interior body, said arc-shaped channel is below the top surface of the other of said left connecting part and said right connecting part, said free portion of said seamless spring piece is inserted into said arc-shaped channel to completely eliminate the gaps between said left connecting part and said right connecting part when joined together.

2. The surface-seamless steel rail according to claim 1, wherein the fixed connection of said seamless spring piece is obtained by welding.

3. The surface-seamless steel rail according to claim 1, wherein said seamless spring piece is comprised of a plurality of spring sheet layers that are flatly stacked at said fixed portion and welded together, and the end of said free portion of said seamless spring piece has a shape that fits into said arc-shaped channel.

4. The surface-seamless steel rail according to claim 3, wherein the end of said free portion of said seamless spring piece has an angle less than 90 degrees.

5. The surface-seamless steel rail according to claim 1, wherein said left connecting part and said right connecting part have the same overall height, and said plug portions of said left connecting part and said right connecting part have the same height and the same length.

6. The surface-seamless steel rail according to claim 5, wherein the height of said plug portion is less than the height of said left connecting part and said right connecting part, wherein the difference in height equals to the thickness of said seamless spring piece.

7. The surface-seamless steel rail according to claim 1, wherein the top edge of said arc-shaped channel coincides with the top of said left connecting part or said right connecting part that is immediately adjacent to said plug portion.

8. The surface-seamless steel rail according to claim 1, wherein the fit tolerance between said free portion of said seamless spring piece and said arc-shaped channel is in the range of 0.05 mm to 0.1 mm interference fit that corresponds to a thickness value by which the thickness of said seamless spring piece is greater than the breadth of said arc-shaped channel.

9. The surface-seamless steel rail according to claim 1, wherein the length of said fixed portion of said seamless spring piece is the same as said plug portions of said left connecting part and said right connecting part.

10. The surface-seamless steel rail according to claim 1, wherein the length of said free portion of said seamless spring piece is determined by the product of the segment rail length, the rail thermal expansion coefficient, the regional maximum temperature difference and a correction factor.

11. The surface-seamless steel rail according to claim 10, wherein said correction factor is selected between 0.9 and 1.2.

12. The surface-seamless steel rail according to claim 10, wherein said correction factor is 1.

13. The surface-seamless steel rail according to claim 1, wherein said surface-seamless steel rail has the same cross-section as the cross-section of the top of the steel rail with the same height.

* * * * *